US010384097B2

(12) United States Patent
Kaan et al.

(10) Patent No.: US 10,384,097 B2
(45) Date of Patent: Aug. 20, 2019

(54) EXERCISE DEVICE

(71) Applicant: Elbersen Beheer B.V., Haarlem (NL)

(72) Inventors: Jan Wouter Kaan, Haarlem (NL); Ronald Hendrikus Dionisius Elbersen, Haarlem (NL)

(73) Assignee: ELBERSEN BEHEER B.V., Haarlem (NL)

( * ) Notice: Subject to any disclaimer, the term of this patent is extended or adjusted under 35 U.S.C. 154(b) by 58 days.

(21) Appl. No.: 14/482,371

(22) Filed: Sep. 10, 2014

(65) Prior Publication Data

US 2015/0080190 A1 Mar. 19, 2015

(30) Foreign Application Priority Data

Sep. 11, 2013 (EP) ..... 13183916

(51) Int. Cl.

| | |
|---|---|
| ***A63B 22/06*** | (2006.01) |
| ***A63B 69/16*** | (2006.01) |
| ***A63B 22/00*** | (2006.01) |
| ***A63B 21/00*** | (2006.01) |

(52) U.S. Cl.

CPC .... *A63B 22/0605* (2013.01); *A63B 21/00196* (2013.01); *A63B 22/0046* (2013.01); *A63B 69/16* (2013.01); *A63B 2022/0611* (2013.01); *A63B 2022/0658* (2013.01)

(58) Field of Classification Search

CPC ..... B62M 3/00; B62M 3/06; A63B 22/0605; A63B 2022/0611; A63B 69/16; A63B 2022/0623; A63B 2022/0629; A63B 2022/0617; A63B 69/69; A63B 22/0046; A63B 21/00196; A63B 2022/0658

USPC ..... 482/57–62; 74/594.1–594.7

See application file for complete search history.

(56) References Cited

U.S. PATENT DOCUMENTS

| | | | | | |
|---|---|---|---|---|---|
| 3,865,366 | A * | 2/1975 | Stantial | A63B 22/0605 | 482/57 |
| 3,888,136 | A * | 6/1975 | Lapeyre | B62M 3/02 | 280/259 |
| 4,019,230 | A * | 4/1977 | Pollard | B62M 1/24 | 280/214 |
| 4,159,652 | A * | 7/1979 | Trammell, Jr. | B62M 1/26 | 280/259 |
| 4,281,845 | A * | 8/1981 | Brown | B62M 3/06 | 280/236 |
| 5,261,294 | A * | 11/1993 | Ticer | B62M 3/02 | 280/260 |
| 5,397,286 | A * | 3/1995 | Chang | A63B 21/157 | 482/59 |

(Continued)

FOREIGN PATENT DOCUMENTS

| | | |
|---|---|---|
| WO | 2008051693 | 5/2008 |
| WO | 2010005286 | 1/2010 |

*Primary Examiner* — Megan Anderson

(74) *Attorney, Agent, or Firm* — Steven M. Koehler; Westman, Champlin & Koehler, P.A.

(57) ABSTRACT

An exercise device, such as a bicycle or spinning bike, includes a frame, a first set of crank arms connected to a rotary shaft supported by the frame and having an imaginary rotational axis stationary with respect to the frame. A second set of crank arms is mounted eccentrically with respect to the rotational axis of the rotary shaft. A second shaft is coupled to the second set of crank arms such that rotation of the second shaft generates vibrations of the crank arms in the second set of crank arms.

20 Claims, 4 Drawing Sheets

(56) References Cited

U.S. PATENT DOCUMENTS

| | | | | | |
|---|---|---|---|---|---|
| 6,085,613 | A * | 7/2000 | Niculescu | B62M 1/36 | 280/259 |
| 6,152,471 | A * | 11/2000 | Kang | B62M 3/04 | 280/259 |
| 6,474,193 | B1 * | 11/2002 | Farney | A63B 22/0605 | 74/594.3 |
| 6,840,136 | B1 * | 1/2005 | Jones | B62M 1/36 | 280/259 |
| 7,007,570 | B2 * | 3/2006 | Gayoh | B62M 3/06 | 280/236 |
| 2006/0100065 | A1 * | 5/2006 | Maresh | A63B 22/0007 | 482/52 |
| 2006/0160668 | A1 * | 7/2006 | Fan | A61H 1/001 | 482/57 |
| 2009/0211395 | A1 * | 8/2009 | Mul'e | B62M 3/02 | 74/594.7 |
| 2010/0130331 | A1 * | 5/2010 | Hu | A63B 22/0046 | 482/57 |
| 2014/0024502 | A1 * | 1/2014 | Watterson | A63B 22/0605 | 482/57 |
| 2014/0106936 | A1 * | 4/2014 | Puerschel | A63B 21/0051 | 482/6 |
| 2015/0045190 | A1 * | 2/2015 | Keiser | A63B 21/0051 | 482/57 |

* cited by examiner

EXERCISE DEVICE

BACKGROUND

The discussion below is merely provided for general background information and is not intended to be used as an aid in determining the scope of the claimed subject matter.

Aspects of the invention relate to an exercise device, such as a bicycle or spinning bike, comprising a frame, and typically a seat and a handle bar for a user mounted to the frame, and a set of crank arms connected to a rotary shaft having an imaginary rotational axis stationary with respect to the frame.

There are numerous kinds of exercise bikes available in the marketplace. The main structure of these conventional exercise bikes typically includes a frame, a handlebar mounted at a front end of the frame, a display, a seat mounted at a rear end of the frame, and a pair of pedals. The benefits of regular aerobic exercise have been well established and accepted. In addition to enhancing the performance of athletes, such devices are used to improve or maintain the fitness and health of non-athletes.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

One aspect includes at least a second set of crank arms mounted eccentrically with respect to the rotational axis of the shaft.

In an embodiment, the crank arms in the sets are mutually coupled, preferably such that rotation, e.g. by a user, of one set drives the other set, and/or preferably by means of one or more rotating and/or translating, e.g. sliding, elements, such as bearings, pivot arms or shoes.

The further set of crank arms and the eccentrically mounting of these arms provide a relatively straightforward and/or compact mechanism for generating vibrations and transmitting such vibrations to e.g. pedals mounted on the ends of the cranks.

An embodiment comprises a second shaft, preferably a sleeve shaft mounted about the rotary shaft, coupled to the further set of cranks, such that rotation of the second shaft generates vibrations of the cranks in the further set, preferably vibrations superposed on the revolutions of the pedals mounted on that set.

It is preferred that the central axes of the shafts at least substantially coincide.

In an embodiment, the imaginary axis connecting the crank arms in the first set and the imaginary axis connecting the crank arms in the further set are mutually eccentric, i.e., do not coincide.

In a refinement, during cycling, the imaginary axis connecting the crank arms in the further set rotates about the imaginary axis connecting the crank arms in the first set.

In a more detailed embodiment, the device comprises two crank sets, a first crank set comprising the (first) set of crank arms, the rotary shaft, and e.g. a chain ring or pulley fixed to the rotary shaft, and a second crank set comprising the further (second) set of crank arms mounted eccentrically on a sleeve shaft, which in turn is mounted rotatably about and co-axial with the rotary shaft and thus stationary with respect to the frame.

In the above embodiments, the total mass and/or volume of vibrating components and/or parts of components can be (further) reduced and, as a result, during use, the device requires no or less dampening of vibrations transmitted to the frame.

In an embodiment, the shafts are coupled via a transmission having a non-unitary transmission ratio. I.e. rotation of one of the shafts at a first rotational speed results in rotation of the other shaft at a different rotational speed.

Another embodiment comprises a wheel, preferably a flywheel (front or rear) or rear wheel, and one of the shafts, e.g. the driving shaft, is coupled to the wheel via a first transmission and the first transmission or the wheel is coupled to the other shaft, e.g. the driven shaft, via a second transmission.

In a refinement, each transmission comprises pulleys or chain wheels on a shaft and a belt or chain led over the pulleys respectively chain wheels.

In another embodiment, the overall transmission ratio between the driving shaft and the driven shaft is in a range from 10 to 50, preferably 15 to 30, e.g. 18 to 20, resulting in 10 to 50 vibrations of the pedals per revolution of the crank arms.

In another embodiment, a chain ring or pulley is fixedly coupled to the rotary shaft and is part of the first transmission.

In a further embodiment, the cranks in one of the sets, preferably the further set, are provided with pedals.

Within the framework of the present disclosure, the term "stationary" with respect to the frame means that the shaft referred to, although of course rotatable about an imaginary axis, at least during cycling, substantially does not move relative to the frame. Some movement e.g. resulting from elastic deformation of the frame and/or other components is of course unavoidable.

BRIEF DESCRIPTION OF THE DRAWINGS

Aspects of the invention will now be explained in more detail with reference to the Figures, which show preferred embodiments of the present exercise device.

DETAILED DESCRIPTION OF THE ILLUSTRATIVE EMBODIMENTS

It is noted that the Figures are schematic in nature and that details, which are not necessary for understanding the present invention, may have been omitted. Identical element and elements performing an at least substantially identical function have been indicated the same numeral.

Figure 1:
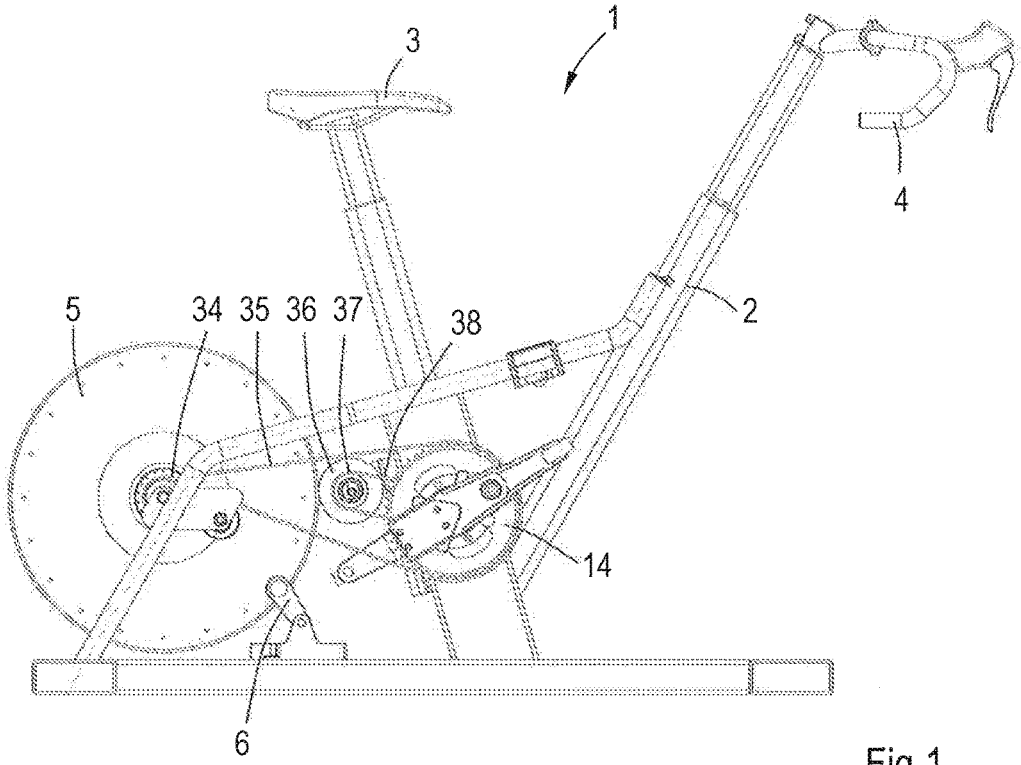
FIGS. 1 and 2 are side views of a spinning bike.
Figure 2:
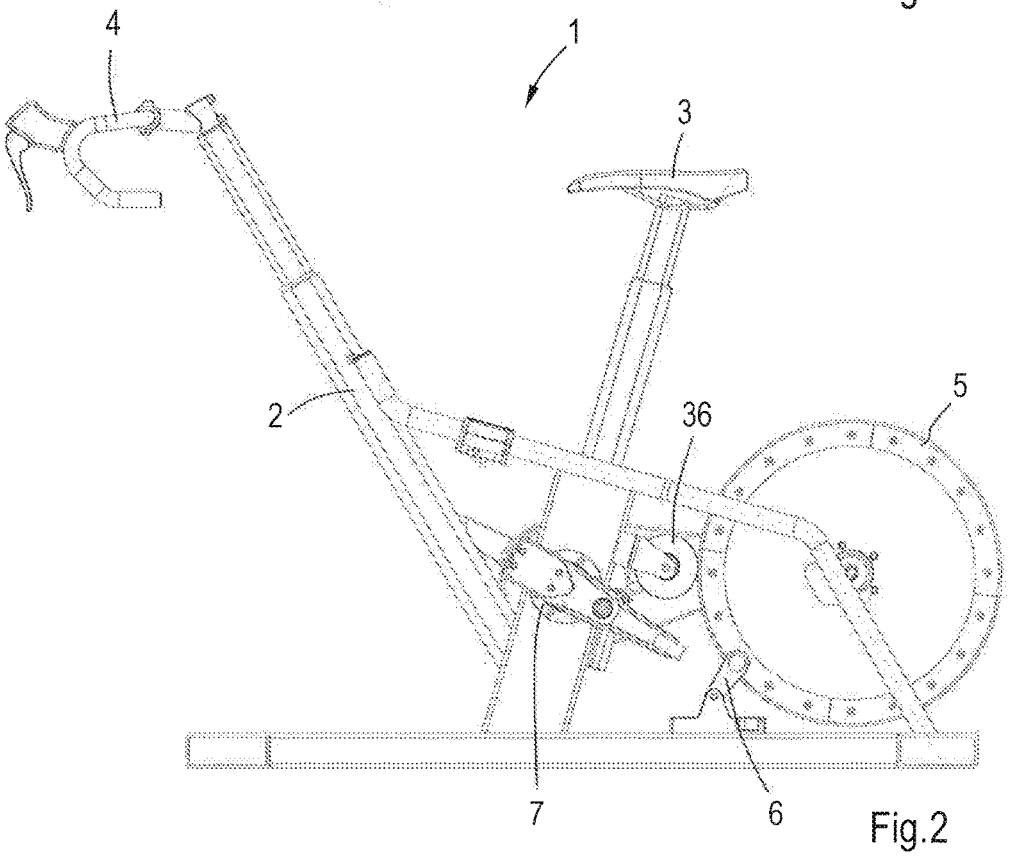

FIGS. 1 and 2 show an example of an exercise device, in this example a spinning bike 1. The bike 1 comprises a frame 2, and a seat 3 and a handle bar 4 mounted to the frame 2. Further mounted in or to the frame are a flywheel 5, an adjustable resistance, e.g. a brake such as an eddy current brake 6 known in itself, a bottom bracket shell 7, and a crank set.

The crank set comprises a main shaft 10 having an imaginary central axis 11 stationary with respect to the frame 2, i.e. the shaft 10 is rotatable about the imaginary axis 11 but, at least during cycling, the axis 11 substantially does not move relative to the frame 2, although some movement e.g. resulting from elastic deformation of the frame 2 and/or other components is of course unavoidable. A pair of first crank arms 12 is fixed to the shaft 10 e.g. by means of bolts 13. A pulley or chain ring 14 is fixed to one of the first cranks, e.g. by means of arms 15 and bolts 16.

A second crank arm 20 is, at a first location eccentric to the imaginary central axis 11, rotatably attached to each of the first crank arms 12, i.c. by means of auxiliary shafts 21 fixed to the first crank arms 12 and rotatably mounted in the (second) cranks 20 by means of ball bearings 22, and, at a second location, eccentric to the imaginary central axis 11 at a an opposite side of the imaginary central axis of the main shaft 10, slidably attached to the first cranks 12, e.g. by means of a slide shoe 23 and guides, such a as pins 24, extending in a radial direction. Each of the slidable attachments comprises an auxiliary rotary shaft 25 having a first, eccentric portion that is rotatably mounted in the shoe 23, e.g. in the middle of the shoe 23 and by means of one or more ball bearings 26, and a second, concentric portion that is rotatably mounted in the first crank 12, e.g. by means of one or more ball bearings 27. The concentric portion comprises a pulley or pinion 28.

A sleeve shaft 30 is mounted in the bottom bracket shell 7 by means of bearings 31 and rotatable about the main shaft 10 by means of bearings 29. The sleeve shaft 30 has an imaginary central axis stationary with respect to the frame 2 and co-axial with the imaginary central axis main shaft 10. The sleeve shaft 30 is provided with a sprocket or pulley 32 to rotate the sleeve by means of a chain or belt, as will be discussed in more detail below, and a pulley or gear 33 coupled to, e.g. by means of a belt, chain or intermesh, to the pulley or pinion 28 on the auxiliary shaft 25.

The main shaft 10 is coupled via a first transmission, e.g. pulleys and a belt or a chain ring 14, sprocket 34 (FIG. 1) and a chain 35, to the flywheel 5. The flywheel 5 in turn is coupled via a second transmission to the sleeve shaft 30. In this example, the second transmission comprises an auxiliary wheel 36 that is pressed/urged onto the flywheel 5, preferably onto the circumference or 'tread' of the flywheel 5 and with the axes of the flywheel 5 and auxiliary wheel 36 in parallel. The auxiliary wheel 36 comprises a pulley 37. A belt 38 is fitted over this pulley 37 and the pulley 32 on the sleeve shaft 30, to transmit power from the flywheel 5 to the vibration mechanism formed by the sleeve shaft 30, the gear 33 and pinion 28, and the auxiliary shaft 25. In this example, the overall transmission ratio between the main shaft 10 and the sleeve shaft 30 directly follows from the transmission ratios of the first and second transmissions.

When the pedals 39, at the ends of the second cranks arms 20, are driven by a user, the second crank arms 20 drive the first crank arms 12, which in turn drive the main shaft 10 and the chain ring 14. The chain ring, chain 35, and sprocket 34 drive the flywheel 5, with the brake 6 providing the resistance required for exercise. The flywheel 5 in turn drives the sleeve shaft 30, which via the gears 33, drives the pinions 28 and the auxiliary shafts 25 that couple the first and second crank arms 12, 20. The (second) auxiliary shafts 25 oscillate the slide shoes 23 in radial direction and vibrate the (second) crank arms 20 about the (first) auxiliary shafts 21 causing the pedals 39 at the ends of the second cranks 20 to vibrate in a substantially tangential direction along the path described by the pedals 39.

Figure 3:
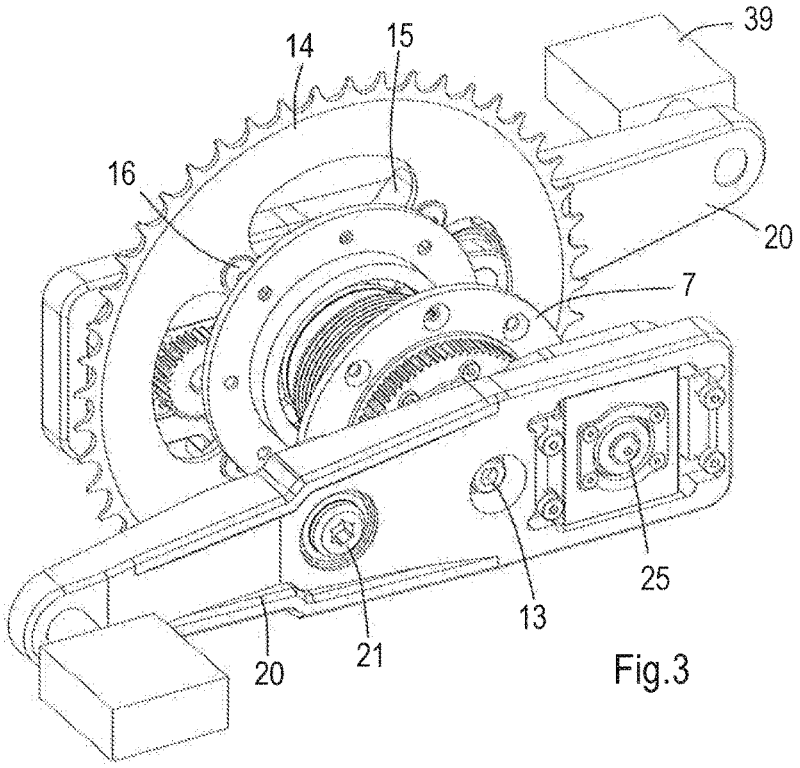
FIGS. 3 and 4 are a perspective view and a cross-section of a bottom bracket assembly and sets of crank arms for an exercise device, such as the spinning bike shown in FIGS. 1 and 2.
Figure 4:
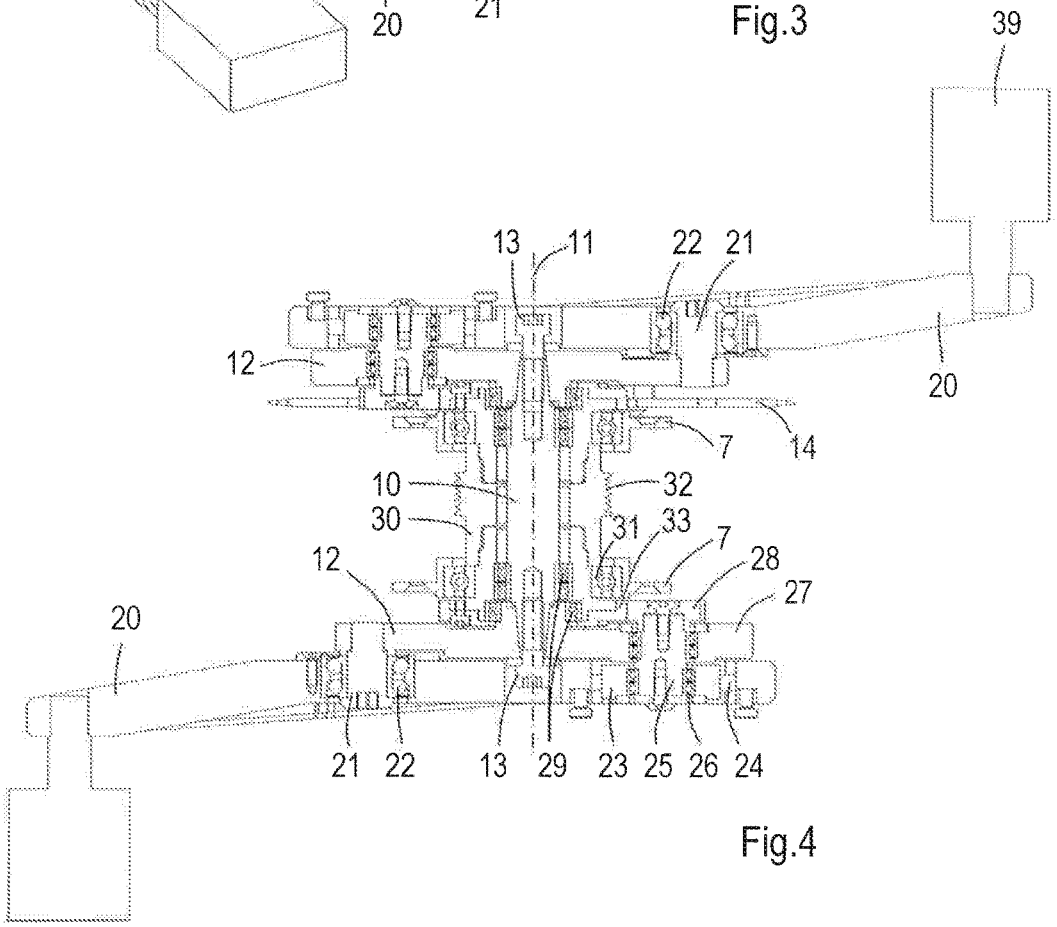
Figure 5:
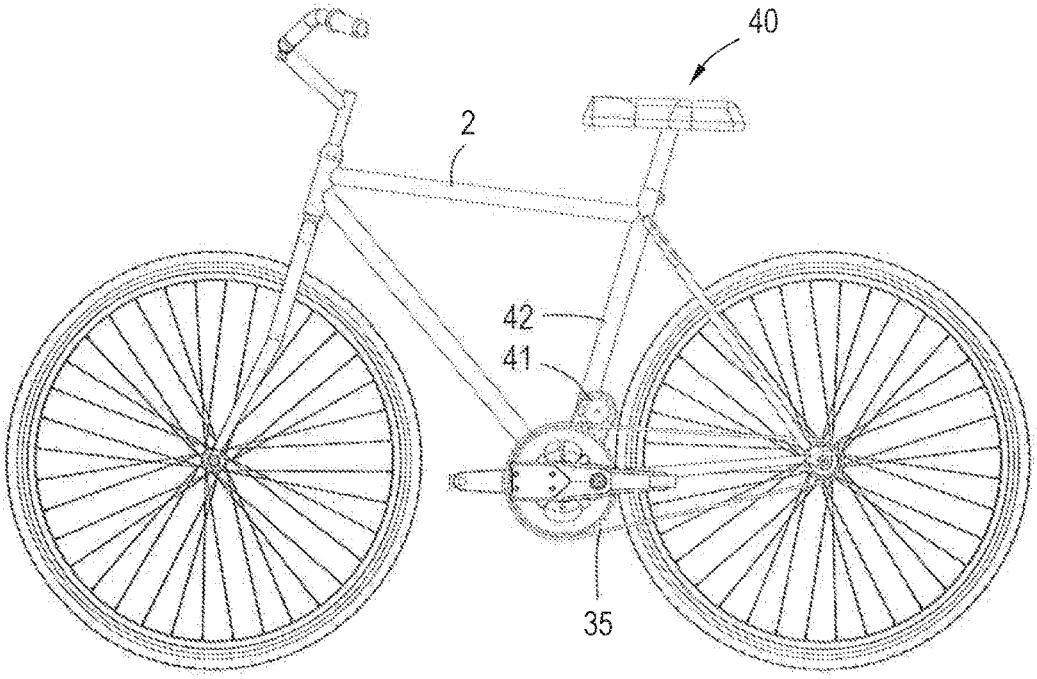
FIG. 5 shows a bicycle comprising a bottom bracket assembly and sets of crank arms as shown in FIGS. 3 and 4.

FIG. 5 shows a bicycle 40 comprising a bottom bracket assembly and crank arms 12,20 as shown in FIGS. 3 and 4. To drive the sleeve shaft 30 and thus generate vibrations, the bicycle 40 comprises an auxiliary sprocket 41 mounted e.g. on the seat post and coupled to the chain 35 of the bicycle 40 and a pulley (hidden from view), co-axial with the sprocket 14 to drive the sleeve shaft 30 and thus the vibration mechanism in the bottom bracket assembly.

Figure 6:
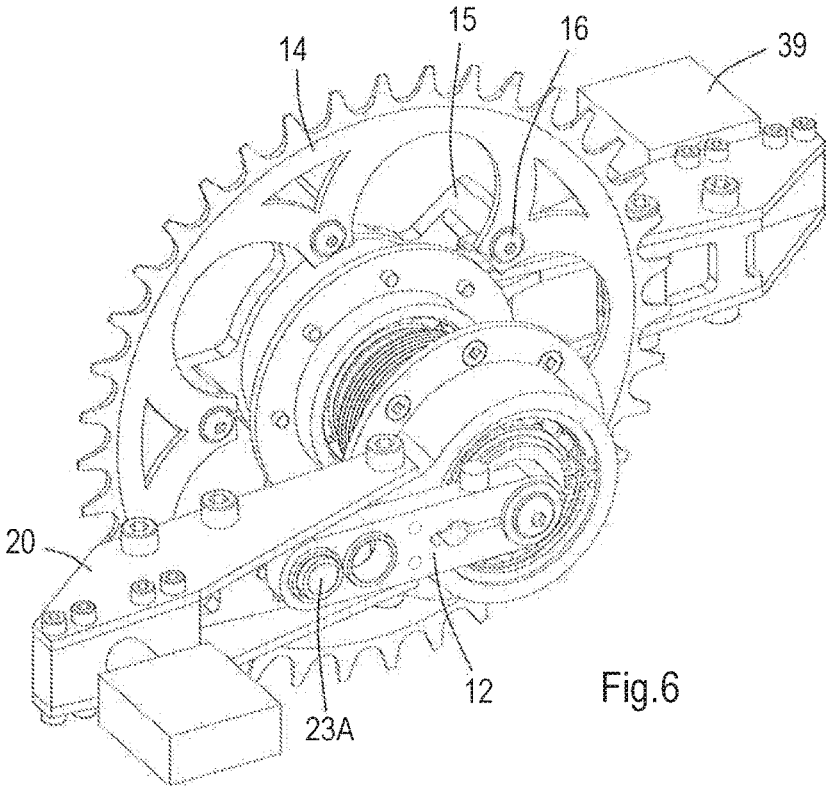
FIGS. 6 and 7 are a perspective view and a cross-section of a further example of a bottom bracket assembly and sets of crank arms for an exercise device.
Figure 7:
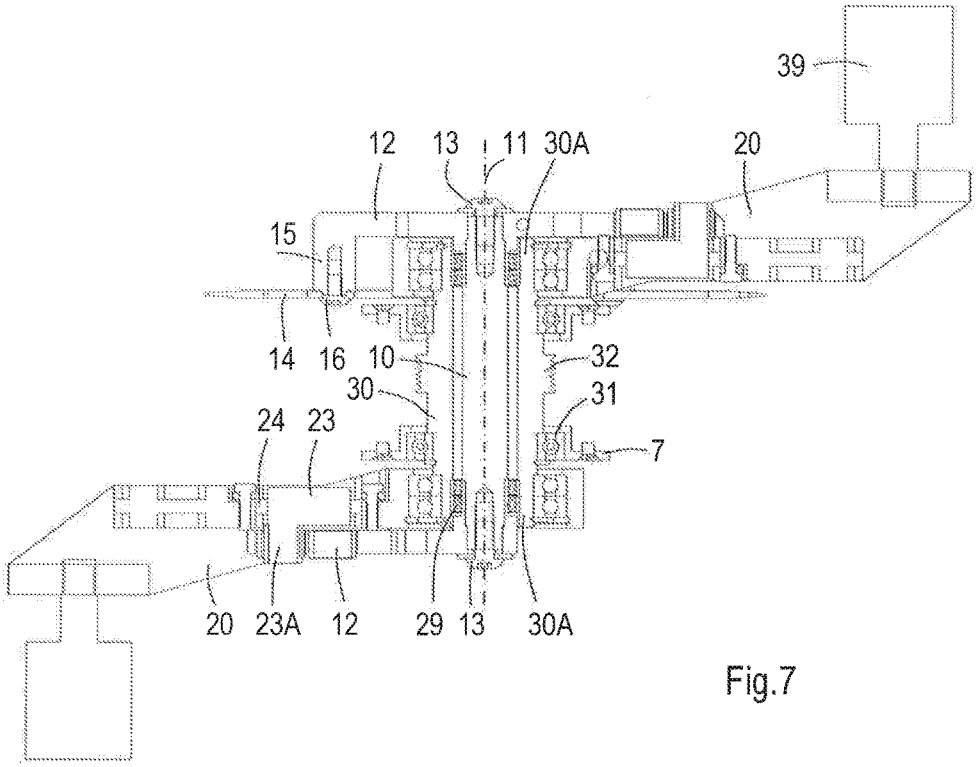

FIGS. 6 and 7 show another example of a bottom bracket assembly and sets of crank arms 12,20. In this example, a pair of first crank arms 12 are fixed to a main shaft 10 e.g. by means of bolts 13. A pulley or chain ring 14 is fixed to one of the first cranks 12, e.g. by means of arms 15 and bolts 16.

A sleeve shaft 30 is rotatably mounted in the bottom bracket shell 7 by means of bearings 31. It is mounted about the main shaft 10 (by means of bearings 29) and has an imaginary rotational axis stationary with respect to the frame and co-axial with that of the main shaft 10. The sleeve shaft 30 comprises two eccentric portions 30A, in this example located at the ends of the shaft 10. The sleeve shaft 30 is provided with a sprocket or pulley 32 to rotate the sleeve by means of a chain or belt, similar to the sleeve discussed above in reference to the example shown in FIGS. 3 and 4.

A pair of (second) crank arms 20 is rotatably attached to the eccentric portions 30A of the sleeve shaft 30, i.e. mounted eccentrically with respect to the imaginary rotational axis of the main shaft 10, and coupled to the first crank arms 12 at a further location (23A) also eccentric to the imaginary central axis 11. In this example, each of the couplings between the two sets of crank arms 12,20 comprises a slide shoe 23 and guides, such a as pens 24, mounted in the second crank arm 20 and extending in the radial direction. The slide shoe comprises a shaft 23A rotatably mounted in the corresponding first arm 12.

When the pedals 39 are driven by a user, the second crank arms 20 drive the first crank arms 12, which in turn drive the main shaft 10 and the chain ring, which in turn, via first and second transmission, drive the sleeve shaft 30. The eccentric portions on the sleeve shaft 30 cause the second crank arms 20 and the pedals 39 at the ends of the second cranks 20 to vibrate (waggle) in a substantially tangential direction along the path described by the pedals 39.

Figure 8:
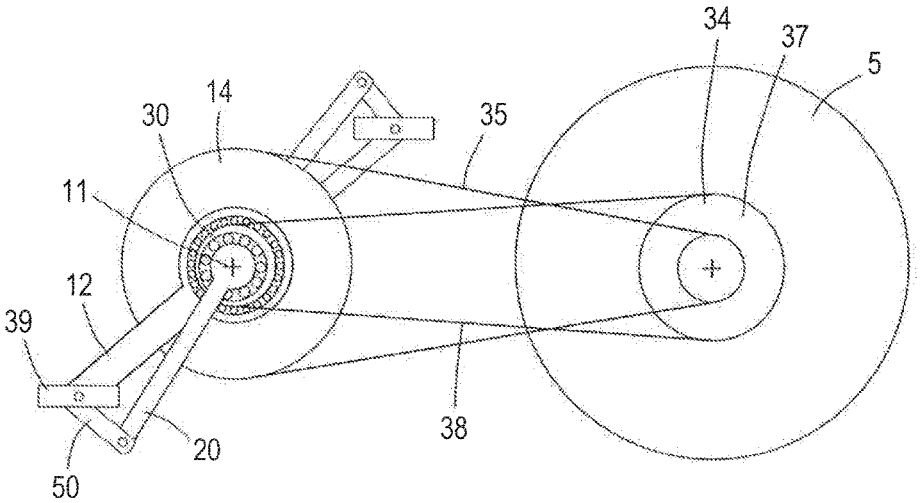
FIG. 8 is a schematic view of another example of a bottom bracket assembly and sets of crank arms for an exercise device.

FIG. 8 shows a variant of the example shown in FIGS. 6 and 7, wherein the second cranks arms are connected, via pivot arms 50, to the ends of the first cranks 12.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. An exercise device comprising:

a frame;

a first set of crank arms connected to a rotary shaft supported by the frame and having an imaginary rotational axis stationary with respect to the frame;

a second set of crank arms mounted eccentrically with respect to the imaginary rotational axis of the rotary shaft; and a second shaft coupled to the second set of crank arms and to the rotary shaft via a transmission having a non-unitary transmission ratio such that rotation of the rotary shaft and/or the second shaft generates a plurality of vibrations of the second set of crank arms for each revolution of the second set of crank arms.

2. The exercise device according to claim 1, comprising two crank sets, a first crank set comprising the first set of crank arms and the rotary shaft, and a second crank set comprising the second set of crank arms mounted eccentrically on the second shaft being a sleeve shaft, which in turn is mounted rotatably about and co-axial with the rotary shaft.

3. The exercise device according to claim 2, wherein the rotary shaft and the sleeve shaft are coupled to each other via the transmission having the non-unitary transmission ratio.

4. The exercise device according to claim 3, and further comprising a wheel, wherein one of the rotary shaft and the sleeve shaft is coupled to the wheel via a first transmission and the first transmission or the wheel is coupled to the other of the rotary shaft and the sleeve shaft via a second transmission.

5. The exercise device according to claim 4, wherein the first and the second transmission each comprise:

pulleys and a belt led over the pulleys; or chain wheels and a chain led over the chain wheels.

6. The exercise device according to claim 4, wherein a chain ring or pulley is fixedly coupled to the rotary shaft and is part of the first transmission.

7. The exercise device according to claim 3, wherein the non-unitary transmission ratio between the rotary shaft and the sleeve shaft is in a range from 10 to 50.

8. The exercise device according to claim 1, wherein each crank arm in the first set of crank arms is mutually coupled to one of the crank arms of the second set of crank arms.

9. The exercise device according to claim 8, wherein the crank arms in the first and second sets of crank arms are coupled such that rotation of one set drives the other set.

10. The exercise device according to claim 8, and further comprising one or more rotatable and/or translatable element coupling the crank arms in the first and second sets of crank arms and arranged to rotate or translate relative to the first set of crank arms or the second set of crank arms.

11. The exercise device according to claim 8, and further comprising one or more rotatable and translatable couplers mutually coupling the crank arms in the first and second sets of crank arms and arranged to rotate or translate relative to the first set of crank arms or the second set of crank arms.

12. The exercise device according to claim 1, wherein an imaginary axis connecting the crank arms in the first set of crank arms and an imaginary axis connecting the crank arms in the second set of crank arms are mutually eccentric.

13. The exercise device according claim 12, wherein the crank arms in the first set of crank arms and the crank arms in the second set of crank arms are mounted with respect to each other such that during cycling the imaginary axis connecting the crank arms in the second set of crank arms rotates about the imaginary axis connecting the crank arms in the first set of crank arms.

14. The exercise device according to claim 1, wherein the imaginary central axis of the rotary shaft and an axis of the second shaft coincide.

15. The exercise device according to claim 1, wherein the crank arms in one of the first and second sets of crank arms are provided with pedals.

16. The exercise device according to claim 1 wherein the second shaft is a sleeve shaft mounted about the rotary shaft.

17. The exercise device according to claim 1 wherein the second set of crank arms includes pedals and the second shaft is coupled to the second set of crank arms such that rotation of the second shaft generates vibrations that are superposed on revolutions of the pedals on the second set of crank arms.

18. The exercise device according to claim 1 and further comprising a pedal mounted to each arm of the second set of crank arms and wherein the pedals vibrate in a tangential direction along a path described by each of the pedals.

19. An exercise device comprising:

a frame;

a first set of crank arms connected to a rotary shaft supported by the frame and having an imaginary rotational axis stationary with respect to the frame;

a second set of crank arms mounted eccentrically with respect to the imaginary rotational axis of the rotary shaft; and a second shaft coupled to the second set of crank arms and to the rotary shaft via a transmission having a non-unitary transmission ratio such that rotation of the rotary shaft and/or the second shaft generates 10-50 vibrations per revolution of the second set of crank arms.

20. The exercise device according to claim 19 and further comprising a pedal mounted to each arm of the second set of crank arms and wherein the pedals vibrate in a tangential direction along a path described by each of the pedals.

* * * * *